US006241008B1

(12) United States Patent
Dunbar

(10) Patent No.: US 6,241,008 B1
(45) **Date of Patent: *Jun. 5, 2001**

(54) CAPILLARY EVAPORATOR

(75) Inventor: Neil William Dunbar, Stevenage (GB)

(73) Assignee: Matra Marconi Space UK, Ltd., Middlesex (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/843,439

(22) Filed: Apr. 16, 1997

(30) Foreign Application Priority Data

May 3, 1996 (GB) ..... 9609277

(51) Int. Cl.[7] ..... F28D 15/00
(52) U.S. Cl. ..... 165/104.26; 165/907; 165/905
(58) Field of Search ..... 165/104.26, 80.3, 165/905, 185, 907, 41; 126/45, 96; 361/700; 257/715; 174/15.2

(56) References Cited

U.S. PATENT DOCUMENTS

| | | | | |
|---|---|---|---|---|
| 3,598,180 | | 8/1971 | Moore . | |
| 4,765,396 | * | 8/1988 | Seidenberg | 165/104.26 |
| 4,791,634 | | 12/1988 | Miyake . | |
| 4,883,116 | | 11/1989 | Seidenberg et al. . | |
| 4,934,160 | * | 6/1990 | Mueller | 165/104.26 X |
| 5,303,768 | | 4/1994 | Alario et al. . | |

FOREIGN PATENT DOCUMENTS

| | | | | |
|---|---|---|---|---|
| 0210337 | | 4/1986 | (EP) . | |
| 2742219 | | 6/1997 | (FR) . | |
| 1516041 | | 6/1978 | (GB) . | |
| 1604421 | | 12/1981 | (GB) . | |
| 59-024538 | | 7/1982 | (JP) . | |
| 405052492 | * | 3/1993 | (JP) | 165/104.26 |
| 0517773 | * | 6/1976 | (SU) | 165/104.26 |
| 0848952 | * | 7/1981 | (SU) | 165/104.26 |
| 1000725 | * | 2/1983 | (SU) | 165/104.26 |
| 1038790 | * | 8/1983 | (SU) | 165/104.26 |
| 1041809 | * | 9/1983 | (SU) | 165/104.26 |
| 1467354 | * | 3/1989 | (SU) | 165/104.26 |

* cited by examiner

*Primary Examiner*—Christopher Atkinson
(74) *Attorney, Agent, or Firm*—Donald C. Casey

(57) ABSTRACT

In a capillary evaporator for use in a capillary pumped loop, in which capillary action in a porous wick 7 causes cold liquid to be drawn across the wick and vaporized by a heat input structure 6 and in particular fin 8 of that structure so that the vapour passes around a loop and rejects heat at a condenser in order to cool equipment in the vicinity of the evaporator, the vapour generated in the wick 7 from the liquid/vapor interface (meniscus) 11 is subject to a lower pressure drop than hitherto by virtue of a spacer 14 of greater permeability and thermal conductivity than the wick 7 without the necessity for the meniscus 11 to recede from the fin 8 which would cause an undesirable temperature drop of the meniscus, thereby improving the capacity of the evaporator to pump liquid/vapor around the loop and thus transport heat.

7 Claims, 4 Drawing Sheets

CAPILLARY EVAPORATOR

This invention relates to a capillary evaporator for a loop containing a working fluid in liquid form and in vapour form.

In such loops, the capillary action acts as a pump to draw condensed liquid towards a heat input structure to generate the vapour phase. Such loops are known as capillary pumped loops and are particularly valuable in satellites in which there may be a need to transport heat from equipment such as vacuum tubes, transistors or antennas to remote radiators, or to connect two radiating surfaces. Referring to FIG. 1, working fluid is vaporized in the evaporator 1 and the part 2 of the loop connecting the evaporator 1 and the condenser 3 contains vapour in the section adjacent to the evaporator. Vapour is condensed in the condenser 3, as heat is rejected from it. (In the vacuum of space, heat can only be lost from a satellite by radiation). Liquid is returned at a lower temperature, than upstream of the condenser, to the evaporator 1 via a pipe 4. A reservoir 5 is optionally provided to accommodate volume variation or to provide control. The evaporator is positioned in thermal contact with the heat generating equipment.

Referring to FIGS. 2 and 3, the evaporator comprises an impermeable casing 6 having a liquid input 4 and a separate vapour outlet 2. The liquid is fed to the interior of a porous hollow body 7 (closed at one end) forming a wick, which is held by internal fins 8. Vapour is produced at the outer periphery of the wick 7 and flows along the grooves 9 between the fins 8 to a manifold 10 communicating with the vapour outlet 2.

The casing 6 including fins 8 form a heat input structure to the wick, in that the equipment to be cooled is put in thermal contact with the outer periphery of the casing, or a surface connected to it. Referring to FIG. 4, which shows a fragmentary region B of the plan view of FIG. 3 on a larger scale, cooled liquid enters the interior of the hollow wick 7, and vapour is formed at a liquid/vapour front or meniscus 11, in the vicinity of the foot of each fin 8.

Liquid is drawn across the wick from the inner to the outer diameter by means of capillary action due to the porous nature of the wick, which is typically approximately 50% porous i.e. the cavities in the wick make up around 50% of its total volume.

Conventional designs use either a high conductivity metal wick or a low conductivity plastics wick. The meniscus recedes some distance into the wick as shown, and there is a significant pressure drop for the vapour flowing in the wick, the vapour escaping in the direction of the arrows 12. The vapour then passes along grooves 9 to the manifold region 10 to conduct the vapour out of the evaporator with minimum pressure drop.

Each type of wick has a fundamental drawback. Thus, metal wicks being conductive require a larger cooling of the incoming liquid to the interior of the hollow wick than a lower conductivity plastics wick in order to ensure the temperature at the meniscus is below the saturation temperature of the working fluid, and this in turn calls for a larger surface area of radiator (condenser) than a lower conductivity plastics wick would require. Further, such wicks only work above a certain minimum heat load in order for vapour to be produced at all and in order for the loop to transport heat at all. (The minimum heat load is strongly dependent on temperative and adverse gravitational head.)

An advantage of metal wicks is that their high conductivity means that the meniscus 11 can recede far enough for the amount by which it overlaps the fins 8 (see arrows 12) to be large enough for the pressure drop of the vapour leaving the wick to be acceptably low.

The drawback of plastics wicks is their low conductivity, which has the result that the heat supplied to the wick from the fins 8 is localized in the region of the fins. The amount by which the meniscus retreats depends on the pressure balance in the loop. Thus, the meniscus may not recede far enough from the fins to provide an adequate overlap of meniscus relative to fins 8, resulting in a restricted channel for the vapour to escape (arrows 12), thereby resulting in a larger pressure drop of the vapour leaving the wick then for the metal wick. If the meniscus is able to retreat sufficiently far from the fins 8 to provide a reasonably small pressure drop of the vapour leaving the wick, because of the low conductivity of the wick, there will now be a larger temperature difference between the foot of the fin 8 and the meniscus. This means that the vapour produced from the meniscus is at a lower temperature level than if the meniscus did not recede, and the radiator will not now work so efficiently because it will contain lower temperature vapour, and again a larger radiator surface area is required. The plastics wick does not however require the sub cooling of the incoming liquid which the metal wick requires. Ceramic wicks of low or high conductivity are available, with the attendant disadvantages noted, respectively, for plastics or metal wicks.

The invention provides a capillary evaporator comprising an inlet and an outlet for communication with a loop containing a working fluid, a wick for drawing in by capillary action working fluid in liquid form received from the inlet, and a heat input structure for vaporizing working fluid in the wick for passage through the outlet, wherein the heat input structure is spaced from the wick.

The spacing avoids the need for the meniscus to recede in order to reduce the pressure drop of the vapour leaving the wick, thereby reducing the temperature drop between the heat input structure and the meniscus so that the vapour is produced at a higher temperature and needs a smaller surface area of radiating surface in the loop.

Advantageously, there is provided a conductive spacer for spacing the heat input structure from the wick, the spacer having a greater thermal conductivity than the wick and producing a lower pressure drop per unit length for a given cross-sectional area, for a given vapour, than the wick (preferably less than a tenth of that for the wick and advantageously less than one hundredth of that for the wick.) This is even better than simply having a gap between the wick and the heat input structure, since the spacer still permits a low vapour pressure drop but the meniscus temperature is higher because of the superior conducting properties of the spacer as compared with the conduction provided by the vapour itself in the case where there is simply a gap.

The invention is particularly applicable to wicks of low conductivity, such as plastics material, for example, Teflon, or ceramic material. The spacer is advantageously of metallic material, such as nickel or aluminium, and the average permeability may be at least 10 times the permeability of the wick, preferably at least 100 times the permeability of the wick.

Capillary evaporators for a loop containing working fluid in liquid form and in vapour form, constructed in accordance with the invention, will now be described, by way of example, with reference to the accompanying drawings in which.

Figure 7:
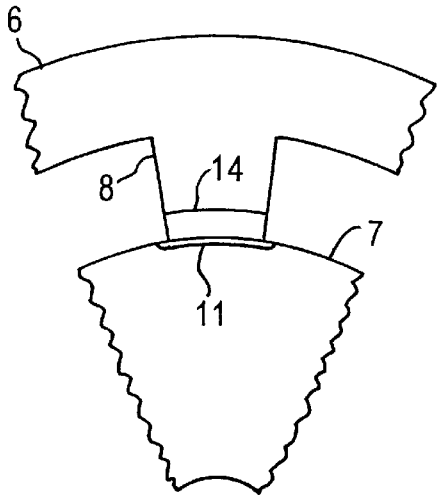
FIG. 7 is a enlarged view of a fragment B of the section of FIG. 6.
Figure 7A:
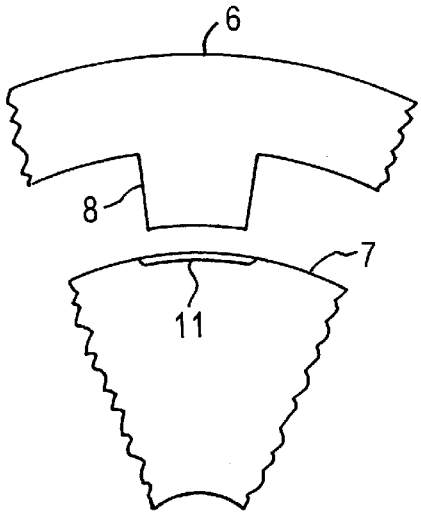
Figure 7B:
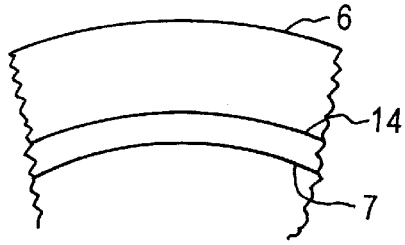
Figure 8:
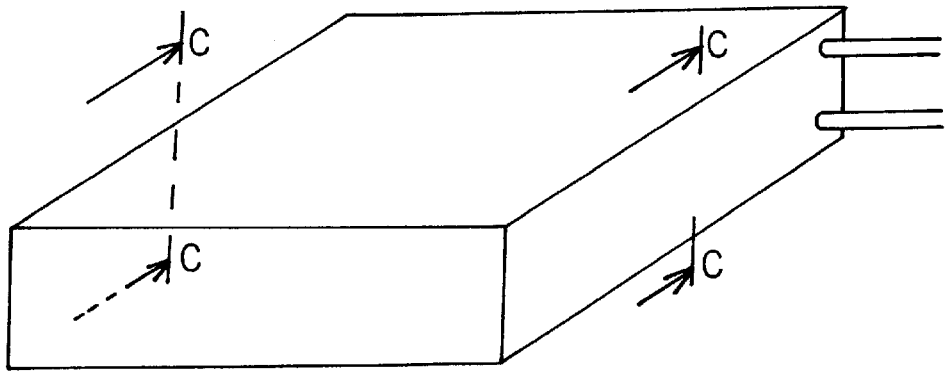
Figure 9:
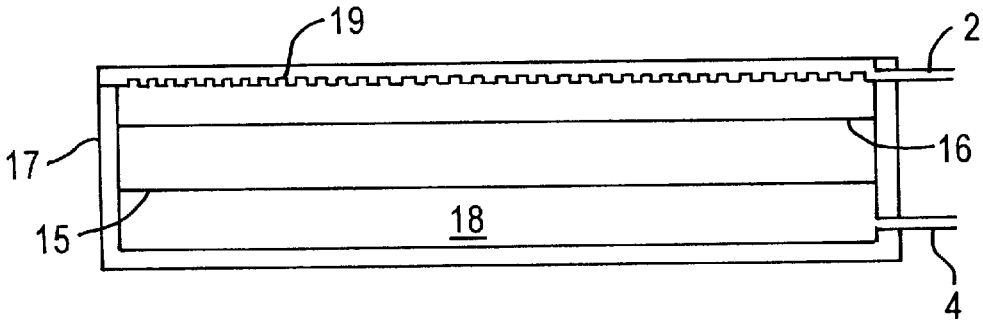

FIG. 7*a* is a view corresponding to fragment B of a variant of the first form of the invention;

FIG. 7*b* is a view corresponding to fragment B of another variant of the first form of the invention;

FIG. 8 is a perspective view of a second form of capillary evaporator in accordance with the invention;

FIG. 9 is a vertical section taken in the direction of the arrows C shown in FIG. 8.

Like reference numerals have been given to like parts throughout all the Figures.

Figure 1:
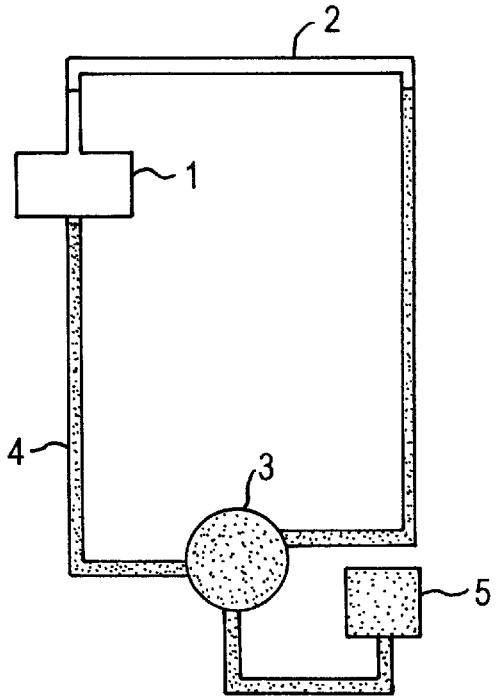
FIG. 1 is a schematic drawing of a capillary pumped loop.

Both forms of capillary evaporator of the invention are employed in loops as shown in FIG. 1 of the drawings. The capillary pressure produced by the action of the meniscus in the porous wick balances the pressure drops due to all other causes around the loop, including, the vapour pressure drop in the wick, the vapour pressure drop in the grooves 9 which conduct the vapour to the vapour outlet, the pressure drop in the vapour pipe 2, the pressure drop in the condenser 3, the pressure drop in the liquid pipe 4, the (small) pressure drop of the liquid traversing through the wick, and the static pressure drop due for instance to adverse gravitational head between evaporator and condenser. The higher the capillary pressure in the wick, the more heat can be transported around the capillary pumped loop. The capillary evaporator 1 is placed in thermal contact with the equipment from which heat is to be transported. This may be equipment in a satellite, for which the invention is particularly applicable.

Figure 5:
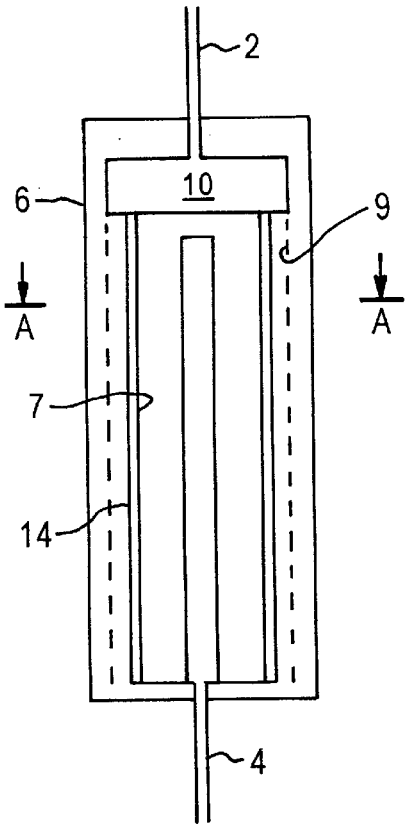
FIG. 5 is an axial cross-section of a first form of capillary evaporator in accordance with the invention.
Figure 6:
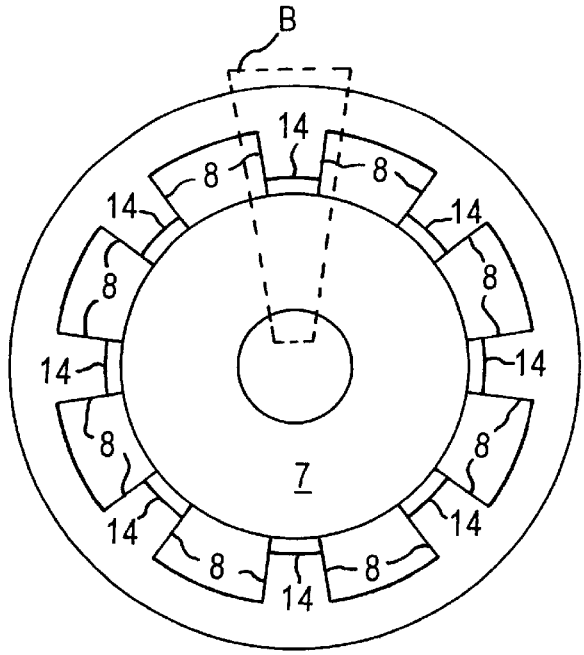
FIG. 6 is a section taken through the plane A—A of FIG. 5.

Referring to FIGS. 5 to 7, the first form of capillary evaporator uses a plastics or ceramic wick 7. In accordance with the invention, part-cylindrical strips 14 are interposed between the fins 8 of casing 6, and the wick 7, forming conductive spacers between the fins 8 and the wick 7. The spacers have a greater thermal conductivity than the wick and the pressure drop through them is substantially less than it would be if they were made of the same material as the wick.

Referring to FIG. 7, it will be seen that vapour can permeate from the outer cylindrical surface of the wick, not only at the ends of the spacers 14, but also directly through the spacers. It is thus possible to arrange that the meniscus 11 does not recede far from the spacers, thereby reducing the temperature drop between the meniscus and the heat input structure, and thereby reducing the size of the radiating surface needed in the condenser 3 in order to radiate the given amount of heat, while in the process the pressure drop encountered by the vapour leaving the wick remains low. Since the wick 11 is of low conductivity plastics or ceramic material, there is good insulation between the inner cylindrical surface and the outer cylindrical surface of the wick, so that the larger degree of sub-cooling required for metallic wicks is avoided, thereby avoiding another factor requiring a larger radiating surface area.

As an example, sizes and materials for the evaporator of the capillary evaporator of the invention may be as follows: material of wick, PTFE; material of outer casing, aluminium alloy; material of spacer, aluminium alloy; inner and outer diameter of wick, 8 mm and 16 mm; length of wick, 200 mm; outer diameter of casing and radial length of fin 8 and of spacers 14, 20 mm, 1 mm, 1–2 mm; proportion of wick formed by cavities 50%, proportion of spacer formed by cavities 70%; thermal conductivity of the spacers and of the wick, 10 watts per metre ° K, 0.1 watts per metre ° K; and pressure drop per unit length for a given cross-sectional area for the vapour, in the spacer compared to in the wick, of the order of $10^{-4}$. Note that this pressure drop corresponds to the following permeabilities of spacer and wick; permeability of spacer $5\times10^{-10}m^2$ and permeability of wick $5\times10^{-14}m^2$. Permeability is inversely proportioned to pressure drop but is otherwise a somewhat complicated factor defined on page 34 of the following reference, Heat Pipes by P. Dunn and D. A. Reay, Pergamon Press, 2nd Edition. For a wick of packed spheres, permeability is related to the square of pore size (the diameter of the individual spaces which, incidentally is not the same as porosity which is the percentage of the material which is space.)

Figure 2:
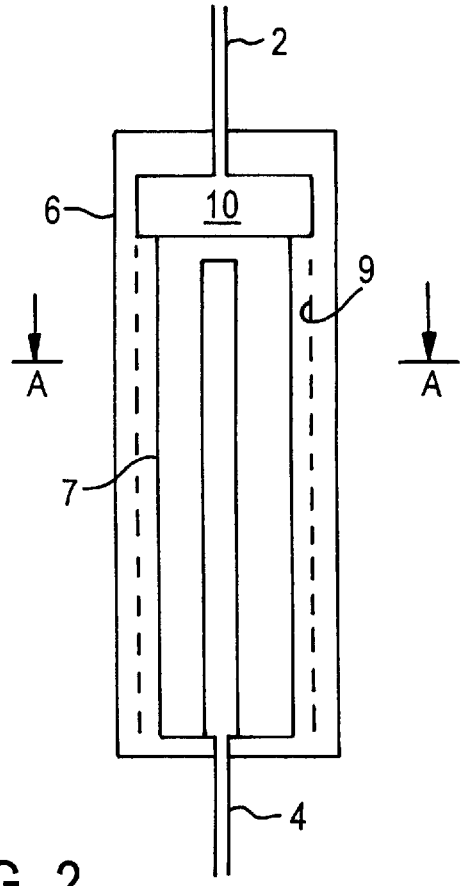
FIG. 2 (PRIOR ART)
FIG. 2 is an axial cross-section of a known form of capillary evaporator.
Figure 3:
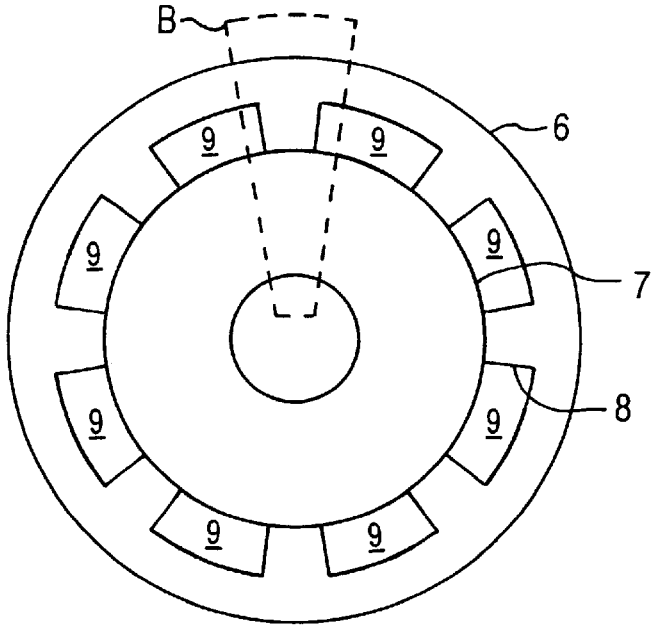
FIG. 3 (PRIOR ART)
FIG. 3 is a section taken across the plane A—A of FIG. 2.
Figure 4:
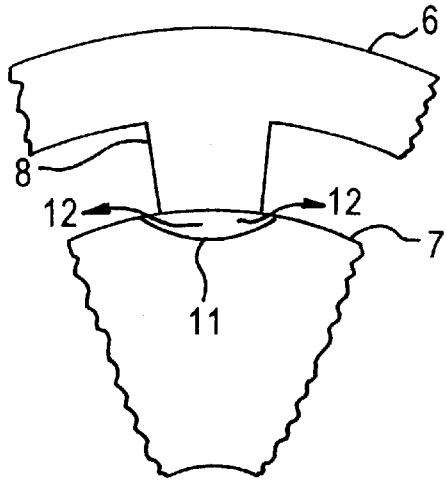
FIG. 4 (PRIOR ART)
FIG. 4 is an enlarged view of fragment B of the section of FIG. 3.

In a variant of the FIGS. 5–7 embodiment, the spacer 14 may be omitted altogether (FIG. 7*a*) and, although the performance is inferior to that of the FIGS. 5–7 embodiment because the vapour is given off at a lower temperature, it is nevertheless superior, when the gap is optimized, to the known form of capillary evaporator described with reference to FIGS. 2–4. In another variant of the FIGS. 5–7 embodiment (FIG. 7*b*), the fins 8 are omitted altogether, and the part-cylindrical spacer strips 14 are formed by a complete cylindrical sleeve 14 in contact both with the interior of the casings 6 and with the exterior of the wick 7. Alternatively, the cylindrical spacer sleeve 14 of FIG. 7*b* may be used in conjunction with a cylindrical wick 7 (as in FIG. 7*b*), but with a casing 6 having internal fins 8 (as in FIG. 7). The inner curved surface of the spacer sleeve 14 contacts the outer curved surface of the wick 7, and the outer curved surface of the sleeve 14 contacts the feet of the fins 8. The fins may be shallower than those shown in FIG. 7.

Referring to FIGS. 8 and 9, the second form of capillary evaporator is flat, and the wick is in the form of a rectangular slab 15. The spacer is also a rectangular slab 16 in contact with the wick, and both are contained in a rectangular casing 17 having a liquid inlet 4 and a vapour outlet 2, the liquid inlet communicating with a hollow region 18 beneath the wick 15 (or the hollow region could be within the wick.) The vapour outlet 2 collects vapour which passes by means of grooves 19 which are formed in the roof of a lid of the hollow casing 17 immediately above the spacer 16. The ends of the grooves at the far end of the evaporator may open into a manifold which communicates with the vapour outlet 2.

The same materials may be used for the second form of capillary evaporator, but suitable dimensions for the evaporator are as follows: width, depth and height of wick, 200×300×10 mm; width, depth and height of spacer 16, 200×300×2 mm; groove width, depth and pitch, 1 mm×1 mm×2 mm.

In both forms of the invention, the working fluid is typically ammonia but many other fluids including water, fluorocarbons and alcohols may also be used.

Of course, variations may be made from the above embodiments without departing from the scope of the invention. Thus, for example, there is no need for the evaporators to take the forms shown in FIGS. 5 to 7 and 8 and 9, and other configurations for the wick spacer and heat input structure are possible. Alternatives for the material for the wick are as follows: polyethylene, polypropylene, or other plastics, alumina, mullite, zirconia or other ceramics. Alternatives for the material of the heat input structure are as follows: stainless steel, copper, inconel. Alternatives for the material of the spacer are as follows: nickel, inconel, copper.

What is claimed is:

1. A capillary evaporator comprising an inlet and an outlet for communication with a loop containing a working fluid, a wick for drawing in by capillary action working fluid in liquid form received from the inlet, and a heat input structure for vaporizing said working fluid in the wick for passage through the outlet, in which there is provided a conductive spacer for spacing the input structure from the wick, the spacer having a greater thermal conductivity than the wick, and producing a lower pressure drop per unit length for a given cross sectional area, for a given vapor, than the wick and the spacer having a higher permeability than the wick.

2. A capillary evaporator as claimed in claim 1, in which the spacer produces less than one tenth of the pressure drop per unit length for a given cross-sectional area, for a given vapor, than the wick.

3. A capillary evaporator is claimed in claim 2, in which the spacer produces less than one hundredth of the pressure drop per unit length for a given cross-sectional area, for a given vapor than the wick.

4. A capillary evaporator as claimed in claim 1, in which the wick is a plastics or ceramic material.

5. A capillary evaporator as claimed in claim 1, in which the spacer is nickel or aluminum.

6. A capillary pumped loop which includes a capillary evaporator as claimed in claim 1.

7. A satellite which includes a capillary pumped loop as claimed in claim 6 for heat transport.

* * * * *